US006155322A

United States Patent [19]

Landan et al.

[11] Patent Number: 6,155,322

[45] Date of Patent: Dec. 5, 2000

[54] LABEL APPLYING APPARATUS AND METHOD THEREFOR

[75] Inventors: Daniel A. Landan, Fairfield; Joseph Dyke, Stratford, both of Conn.

[73] Assignee: Inline Plastics Corp., Shelton, Conn.

[21] Appl. No.: 09/135,272

[22] Filed: Aug. 17, 1998

[51] Int. Cl.[7] ..... B65C 1/02; B65C 1/04

[52] U.S. Cl. ..... 156/542; 156/556; 156/541; 156/DIG. 3; 156/DIG. 4; 53/136.1; 53/329

[58] Field of Search ..... 156/540, 541, 156/542, 556, DIG. 3, DIG. 4; 53/136.1, 136.3, 136.4, 329

[56] References Cited

U.S. PATENT DOCUMENTS

| | | | |
|---|---|---|---|
| 1,072,403 | 9/1913 | Bender . | |
| 1,817,831 | 8/1931 | Molins et al. . | |
| 2,055,508 | 9/1936 | Simon . | |
| 3,681,160 | 8/1972 | Richie et al. | 156/212 |
| 3,869,330 | 3/1975 | Anderson et al. . | |
| 4,181,561 | 1/1980 | Seragnoli | 156/566 |
| 4,293,361 | 10/1981 | Savio et al. . | |
| 4,473,429 | 9/1984 | Crankshaw | 156/483 |
| 4,732,644 | 3/1988 | Chiu . | |
| 5,705,021 | 1/1998 | Wurz et al. | 156/360 |

*Primary Examiner*—Richard Crispino
*Assistant Examiner*—Sue A. Purvis
*Attorney, Agent, or Firm*—Melvin I. Stoltz

[57] ABSTRACT

By providing a system for contacting a label and controllably moving the label into direct, secure, adhesive engagement with a container and its flange member, a dependable, effective, and reliable label applying apparatus and label application method is realized which securely affixes a label in its entirety to a product container on a continuous production basis, totally eliminating unwanted tenting of labels. By employing the present invention, a product holding container, having a forwardly protruding lip or flange, is advanced towards a label dispensing zone with the label positioned for contacting the leading-edge of the forwardly protruding flange. Once the label is attached, typically at its midpoint, to the leading edge of the forwardly protruding lip or flange, label smoothing or tamping means are advanced into contact with the central portion of the label, advancing the center of the label into secure affixation with the top and bottom surfaces of the protruding lip or flange, as well as the front end of the product container.

14 Claims, 7 Drawing Sheets

LABEL APPLYING APPARATUS AND METHOD THEREFOR

TECHNICAL FIELD

This invention relates to production equipment and application methods for applying and affixing labels to packages on a production basis and, more particularly, to such production equipment and application methods which assure secure affixation of the label in its entirety to the package.

BACKGROUND ART

Numerous systems have been developed for applying and affixing labels to a wide variety of packages for a wide variety of different purposes. One such application that has received substantial attention is the affixation of product identifying labels to pre-packaged food products such as fresh bakery items. Typically, fresh bakery items are packaged in transparent plastic containers and product identification labels are affixed to the containers.

In many instances, the transparent plastic container comprises a clamshell construction, with one edge of the container forming the entry zone, with the entry zone incorporating locking means for holding the container in the closed position. In order to provide for the secure retention of the fresh bakery product in the container, as well as provide a tamper evident construction, the product identifying label is placed over the leading edge of the container which forms the entry zone. In this way, a consumer is immediately aware if any package has been opened.

Although this type of construction is widely used in the food industry, particularly with bakery items, one problem that has continued to plague the industry is the inability of the production equipment to eliminate tenting of the label as a label is affixed to the product containing packages. In most packages of this nature, a forwardly protruding ledge or lip is employed on which the locking means are mounted. As a result, when product identifying labels are mounted to these packages in a manner that spans the protruding lip or ledge, the label is affixed to the edge of the lip and the top and bottom of the package. However, the label is not affixed to the side surfaces of the package.

As a result, the label has a characteristic tenting effect, wherein the label is secured along one of its ends to the top of the package and, at its other end, to the package bottom, with the middle of the label affixed to the edge of the protruding lip. However, the middle portion of the label is spaced away from the side of the package, leaving an open spaced zone therebetween. This construction is often referred to as tenting.

Although most producers and product packaging companies have sought to eliminate this tenting effect by using a wide variety of alternate constructions, no system has been developed for effectively resolving this problem. As a result, although substantial effort has been expended in an attempt to reduce or eliminate this visually undesirable tenting effect, no production equipment or method has been produced, prior to the present invention, which satisfies this long-felt need.

Therefore, it is a principal object of the present invention to provide label applying apparatus and label application methods which are capable of securely affixing labels to products on an automated basis with the entire label being secured to the desired product.

Another object of the present invention is to provide label applying apparatus and label application methods having the characteristic features described above wherein the labels are securely affixed to product retaining packages regardless of the construction employed for the product retaining package.

Another object of the present invention is to provide label applying apparatus and label application methods having the characteristic features described above wherein labels are securely affixed to packages spanning the entry portal for the package and providing secure tamper-free and/or tamper-evident closure of the package.

Other and more specific objects will in part be obvious and will in part appear hereinafter.

SUMMARY OF THE INVENTION

By employing the present invention, all of the difficulties and drawbacks found in the prior art are eliminated and a dependable, effective, reliable label applying apparatus and label application method is attained which assures continuous application of labels to products on production basis in a continuous, substantially trouble-free operation. In addition, the present invention also provides means for securely affixing the middle of the label to the product container prior to affixing the ends of the label to the container. In this way, secure affixation of the labels in its entirety to the product container is realized and the unwanted, prior art tenting of labels is eliminated.

In order to provide the secure affixation of a label in its entirety to a product container having a forwardly protruding lip or flange, with the label spanning the protruding lip or flange, precise timing of the label affixation process is required, along with separate, independent label smoothing arms or tamping means constructed for controllably applying the middle portion of the label to the container. In this way, unwanted label tenting is eliminated and the desired secure, continuous, affixation of the label in its entirety to the product retaining package is assured.

In accordance with the present invention, a product retaining package having a forwardly protruding lip or flange is advanced towards a label dispensing zone with the label positioned for contacting the leading-edge of the forwardly protruding lip. Once the label is attached, typically at its midpoint, to the leading edge of the forwardly protruding lip or flange, label smoothing or tamping means are advanced into contact with the central portion of the label, advancing the center of the label into secure affixation with the top and bottom surfaces of the protruding lip or flange, as well as the front end of the product holding package. Thereafter, the label and package assembly are advanced into cooperative interengagement with smoothing arms or brushes for completing the label fixation process by securing the opposed ends of the label to the top and bottom surfaces of the package.

By employing this invention, each and every label is securely affixed, in its entirety, to any desired product retaining package, regardless of the construction of the product retaining package. In addition, by assuring physical contact of the label with the bottom surfaces of the forwardly protruding lip or flange, as well as the front end surfaces of the container, unwanted label tenting is eliminated and securement of the label in its entirety to the package is provided.

In the preferred embodiment, two separate and independent labels moving arms are employed and are constructed for simultaneously contacting the upper and lower surfaces of the protruding lip or flange, as well as the front end surfaces of the package which are adjacent to the flange or lip. Although this construction has been found to efficiently secure the middle of a label to the product holding container and effectively eliminate label tenting, numerous alternate constructions can be employed, without departing from the scope of this invention.

In addition, as is more fully detailed below, the simultaneous activation of the two label smoothing or tamping arms is preferred for optimizing the speed and securement of the label to the container. However, simultaneous activation is not mandatory and other alternate configurations and constructions can be employed in accordance with the present invention.

The invention accordingly comprises the several steps and the relation of one or more of such steps with respect to each of the others, and the apparatus embodied in the features of construction, combination of elements and arrangement of parts which are adapted to effect such steps, all as exemplified in the following detailed disclosure, with the scope of the invention being indicated in the claims.

THE DRAWINGS

For fuller understanding of the nature and objects of the present invention, reference should be had to the following detailed description taken in connection with the accompanying drawings, in which.

Figure 1:
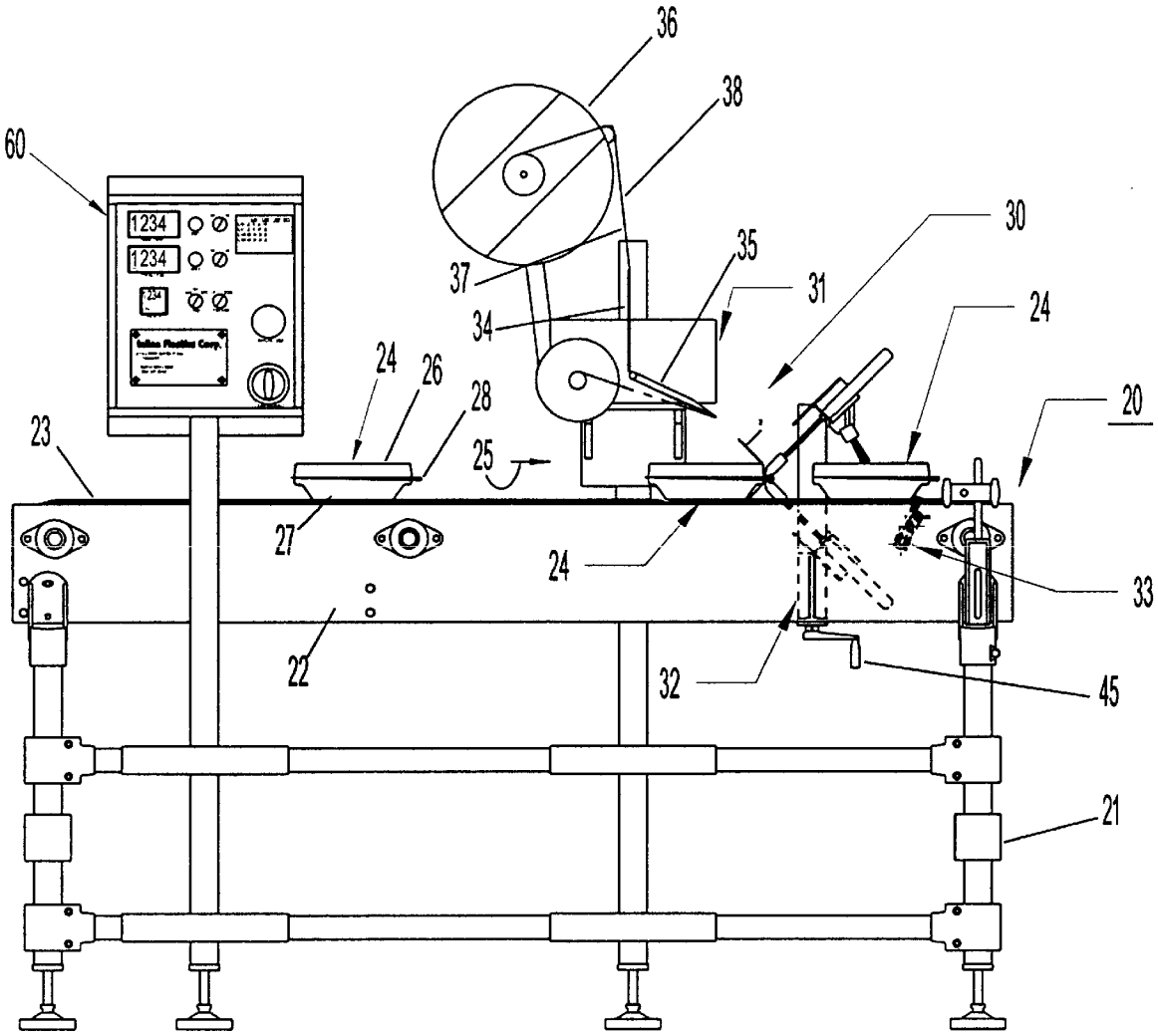
FIG. 1 is a side elevation view of the label applying apparatus of the present invention.
Figure 2:
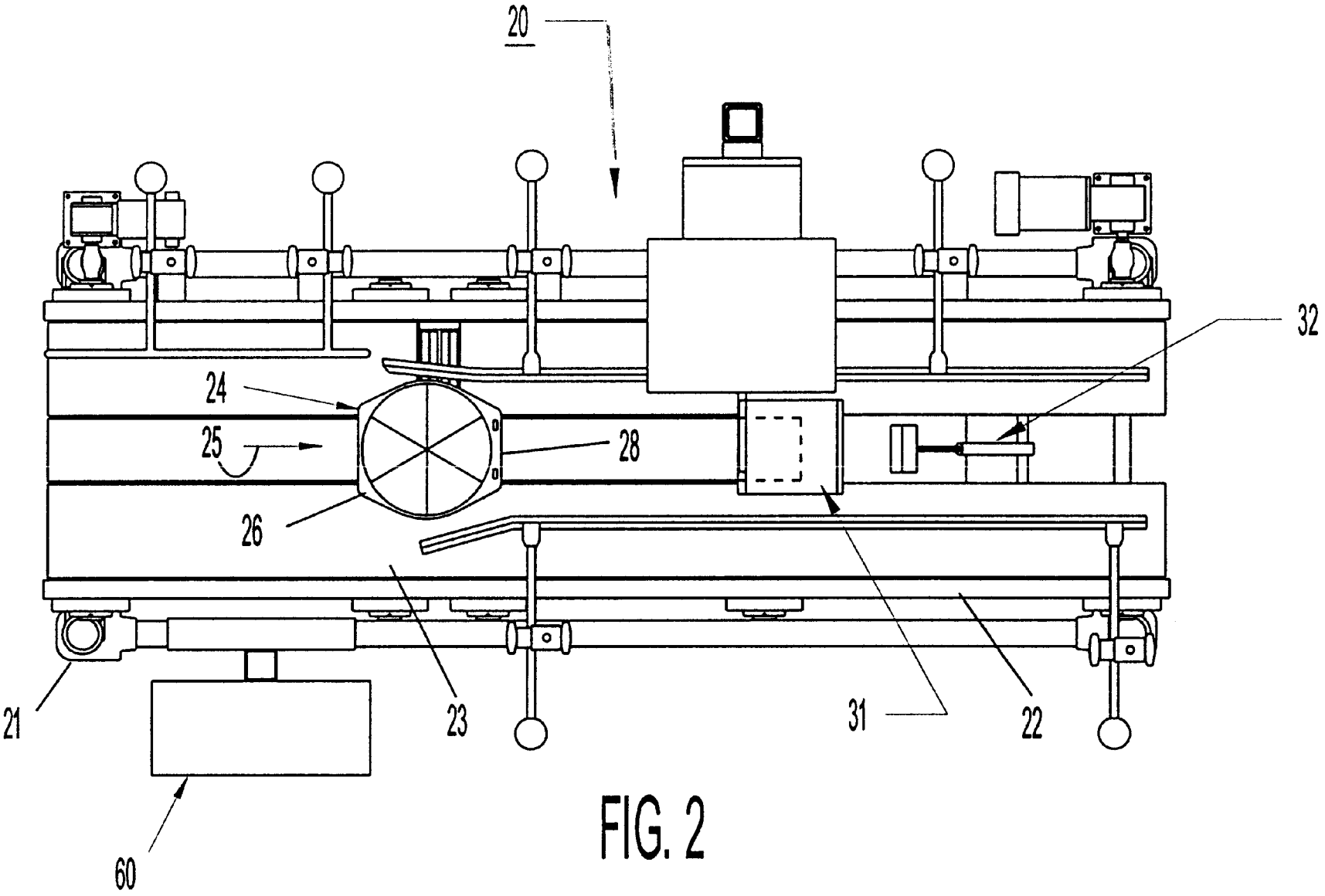
FIG. 2 is a top plan view of the label applying apparatus of FIG. 1.
Figure 3:
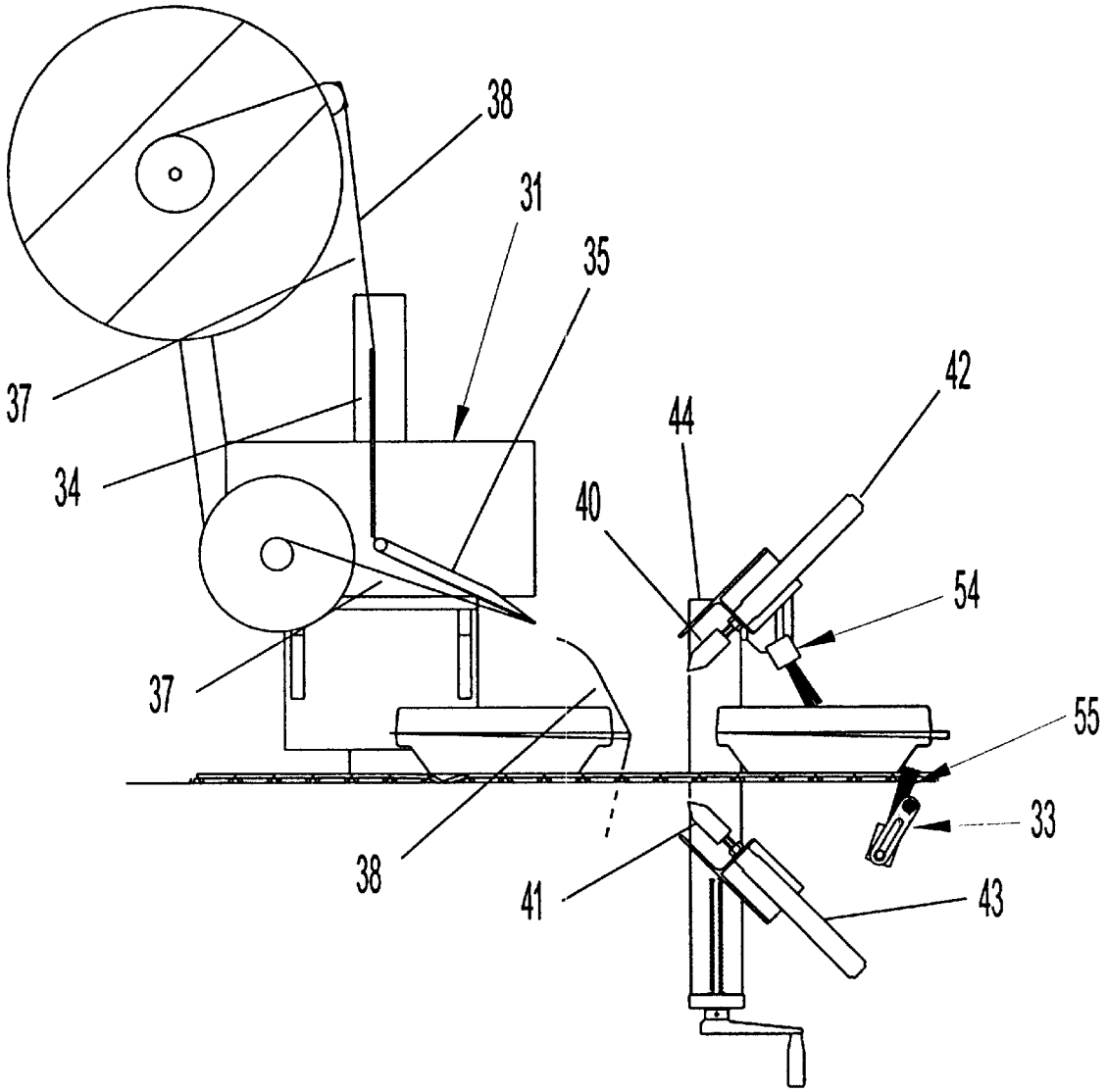
Figure 4:
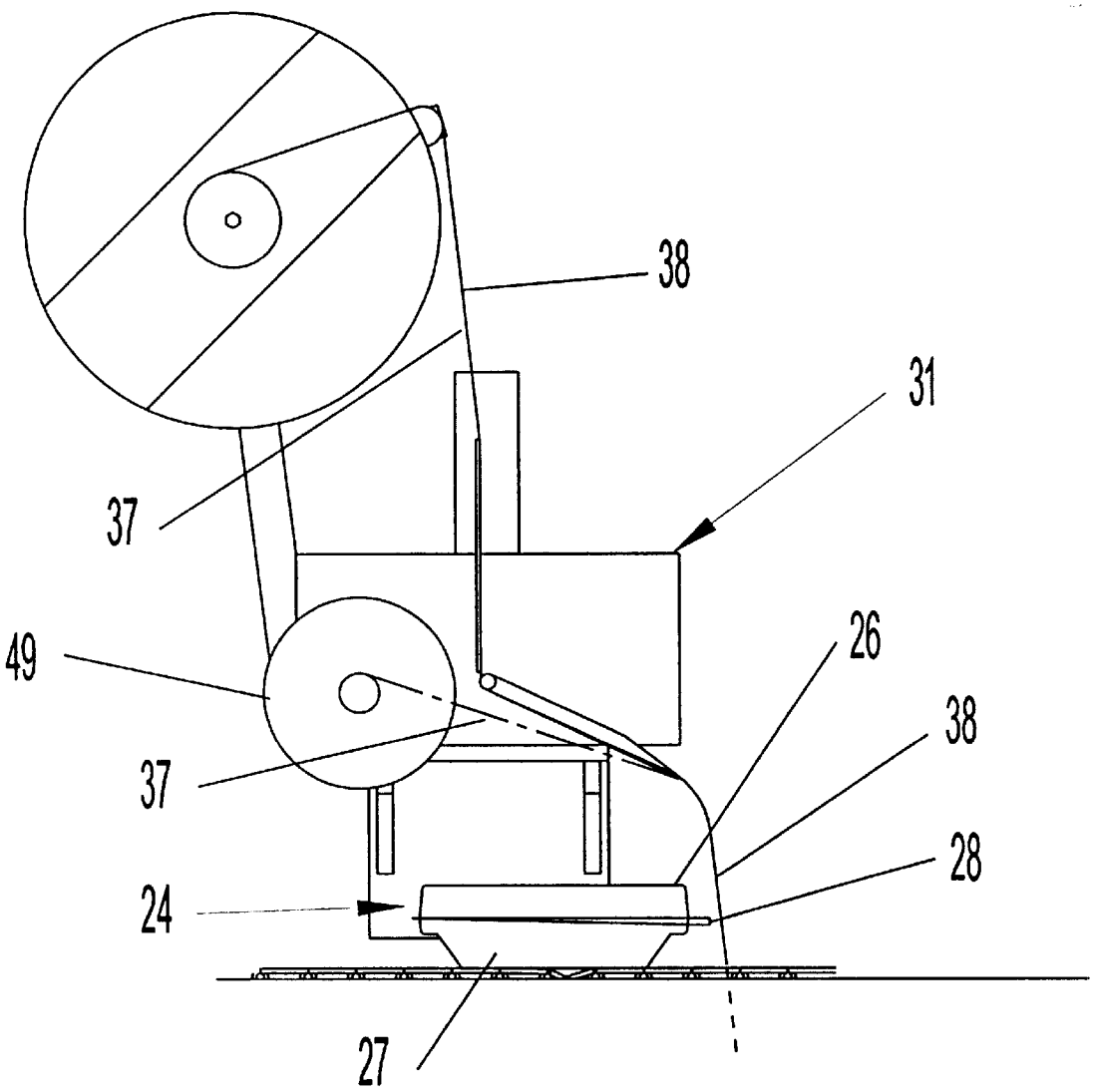
Figure 5:
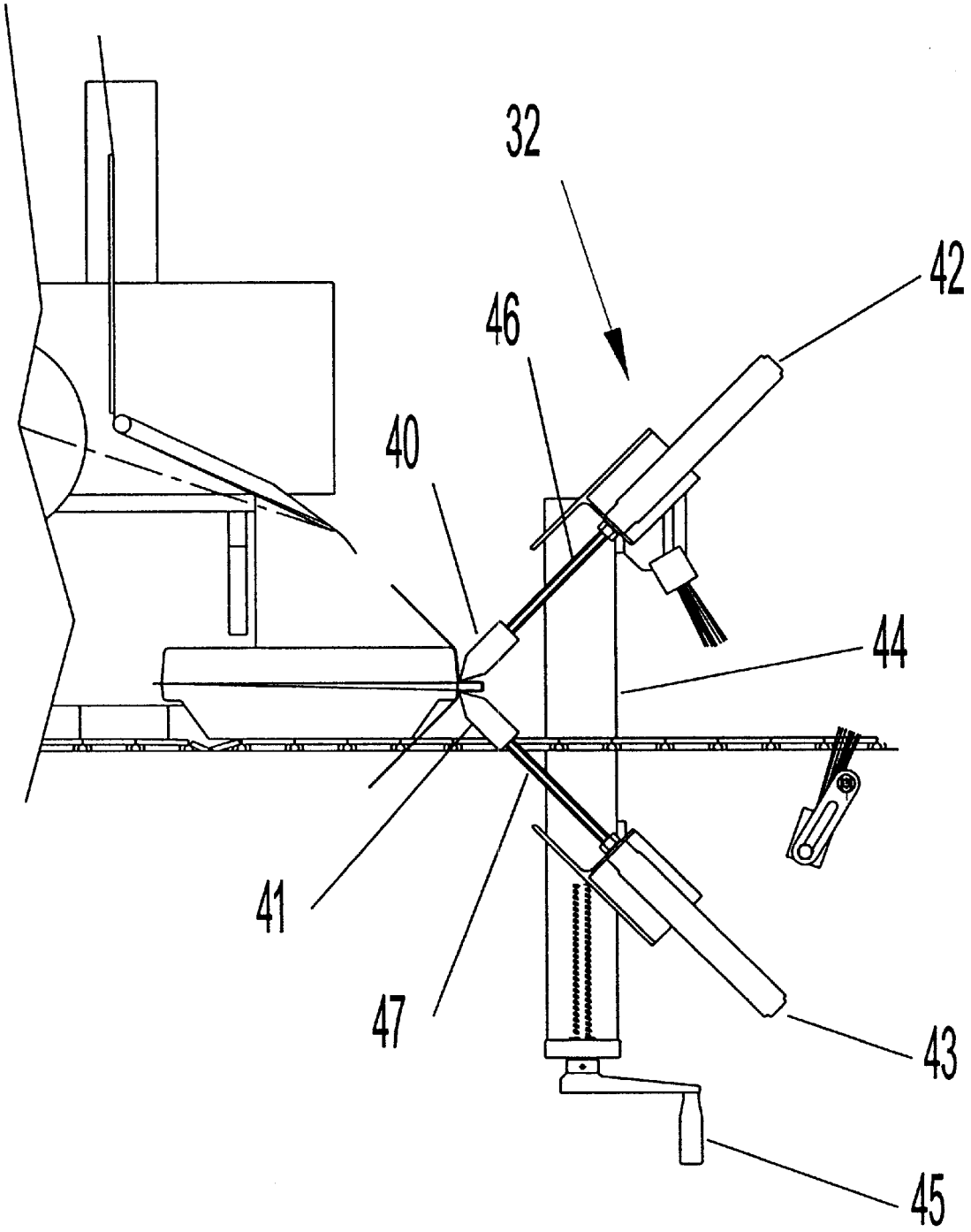
Figure 6:
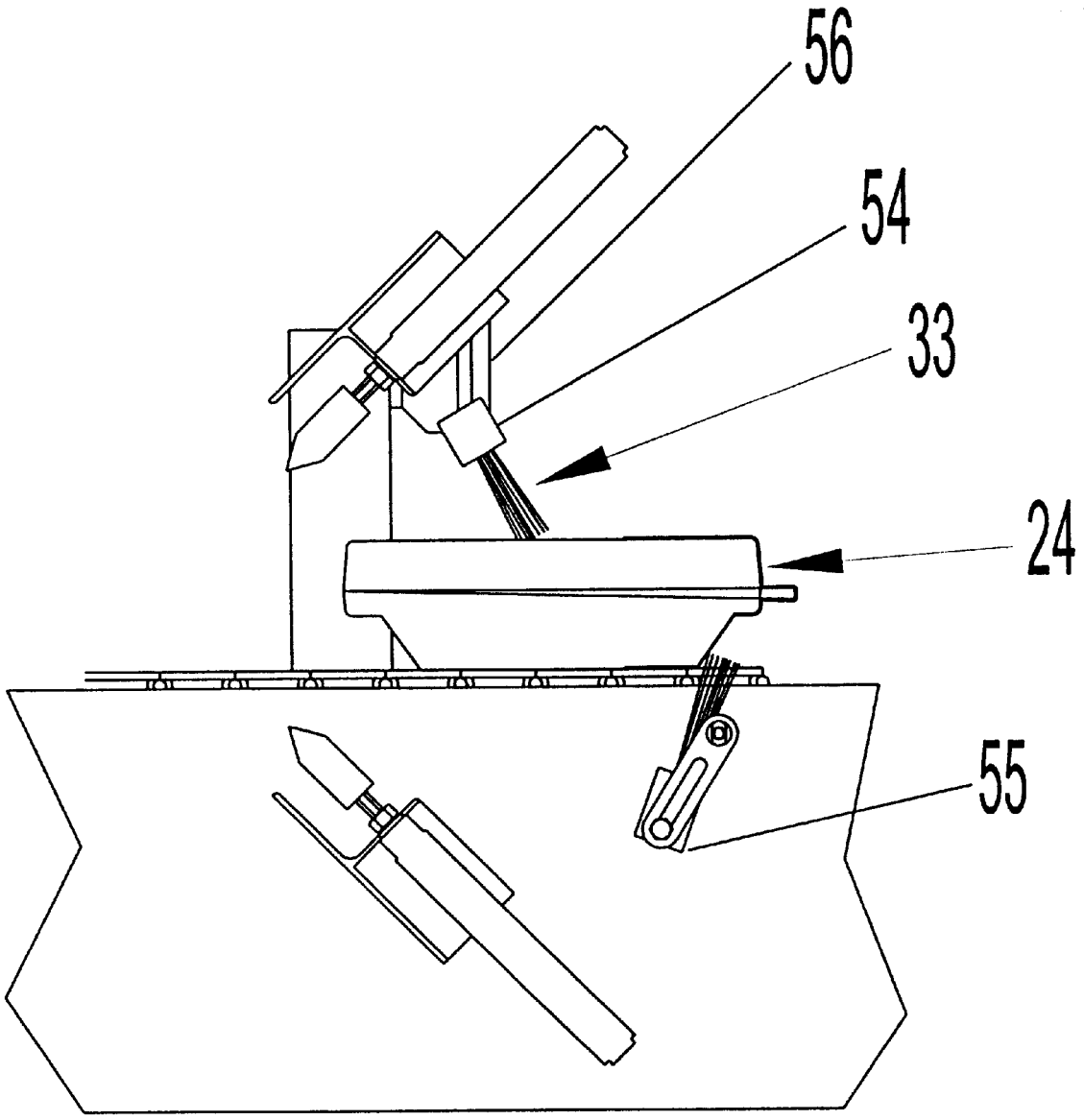
Figure 7:
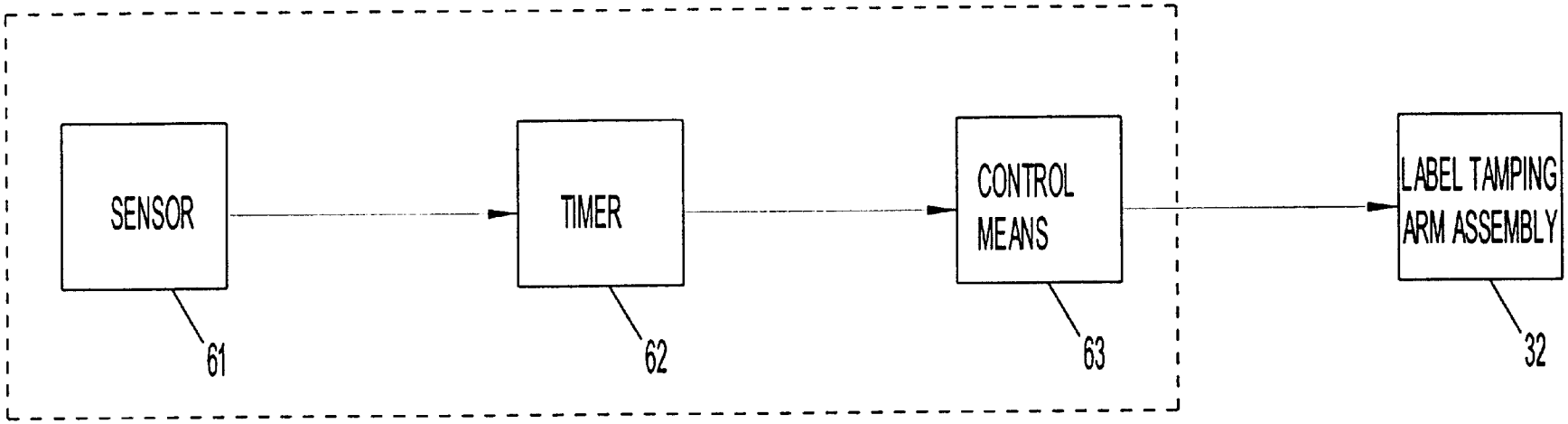

FIG. 3 is a side elevation view, partially broken away, showing a portion of the label applying apparatus of FIG. 1 as an enlarged view, FIGS. 4–6 are side elevation views of the portion of enlarged label applying apparatus of FIG. 2 depicting alternate stages of the label applying process; and FIG. 7 is a schematic block diagram of the control system preferably employed with the label applying apparatus of the present invention.

DETAILED DESCRIPTION

By referring to FIGS. 1–7 along with the following detailed disclosure, the construction and operation of the label applying apparatus and label application method of the present invention can best be understood. In this detailed disclosure, the preferred construction and method are fully detailed and shown. However, as will be evident to one of ordinary skill in the art, alternate embodiments of this invention can be made without departing from the scope of this invention. Consequently, the embodiment depicted in FIGS. 1–6 and detailed in the following disclosure exemplifies the preferred embodiment of the present invention without limiting the present invention to this particular embodiment.

As shown in FIGS. 1 and 2, label applying apparatus 20 comprises supporting frame structure 21 on which is mounted supporting table 22 which incorporates conveyor 23. In the preferred construction, conveyor 23 comprises an endless or continuous belt on which the desired product containers 24 are positioned and advanced in the direction of arrow 25 for secure affixation of a label to the container.

Product container 24 may comprise virtually any desired size or shape while still being able to have label applying apparatus 20 securely affix a label to container 24 in the desired manner. For exemplary purposes, product container 24 is depicted in the drawings as a generally hexagonally shaped container having a clamshell configuration. In addition, container 24 comprises upper portion 26, lower portion 27, and protruding lip or flange 28 which defines the forward edge of product container 24 and the interconnecting juncture between upper portion 26 and lower portion 27, forming the entry portal for product container 24.

In order to securely affix a label to each product container 24 in the desired manner and securely close the entry portal thereof, product container 24 is advanced into cooperative operational engagement with labeling station 30 of label applying apparatus 20. As detail below, labeling station 30 dispenses the desired label for affixation on product container 24, secures the middle portion of the label to the protruding ledge or lip 28 of product container 24, and then affixes the remainder or end portion of the label to container 24, along both the top and bottom surfaces of container 24. Each of the steps are performed sequentially in a precisely timed manner, in order to assure secure affixation of each label to each product container 24, securely closing and sealing upper portion 26 and lower portion 27 to each other along flange 28, while snugly wrapping the label directly to flange 28, the forward end surfaces of container 24, and the top and bottom surfaces of container 24.

In the preferred embodiment, as a depicted in FIGS. 1–6, labeling station 30 of label applying apparatus 20 comprises label dispensing head 31, label tamping arm assembly 32, and label securing brush assembly 33. As detailed below, each of these components of labeling station 30 perform a separate and independent function as product container 24 is advanced on conveyor 23 through each cooperating component.

Each specific member of labeling station 30 operates independently in a cooperative, precisely timed manner in order to provide the desired label affixation. However, in order to detail each step being performed by labeling station 30, each independent operation is separately shown in FIGS. 4–6 and discussed below in relation to each of these Figures.

As shown in FIGS. 1–4, labeling station 30 preferably incorporates a supply of labels retained on spool 36. In the typical construction, an elongated, substantially continuous backing sheet or web 37 is employed for supportingly retaining a plurality of labels 38 thereon. Each label 38 is separated from each adjacent label 38 along its ends by die cutting the labels after printing. In this way, ease of separation of each label 38 from an adjacent label 38 is provided. Labels 38 and web 37 extend from spool 36 onto guide rails 34 and 35 which controllingly advance and direct labels 37 and web 37 from spool 36 to the precisely desired position.

As shown in FIG. 2, conveyor 23 is preferably bifurcated into two separate conveyor elements in the area of labeling station 30. In this way, the desired operations detailed herein are easily performed on the central section of product container 24.

In order to assure the secure affixation of label 38 to container 24, each label 38 comprises an adhesive surface, using any desired prior art adhesives or adhesive systems. Preferably, labels 38 are coated with adhesive material when manufactured and then covered with protective backing sheet or web 37, as discussed above.

As shown in FIGS. 1, 3, and 4, in order to separate labels 38 from web 37 and enable the adhesive faced surface of label 38 to be positioned in the path of container 24, guide rail 35 incorporates a stripper or peeling element at its distal, terminating end which continuously separates web 37 from label 38. In addition, a take-up reel 49 is preferably employed for continuously rolling web 37 onto reel 49 as labels 38 are removed therefrom. In this way, each label 38 is positioned between the bifurcated elements of conveyor 23 with the adhesive surface thereof facing the on-coming product container 24.

As best seen in FIGS. 3 and 4, each label 38 is suspended from web 37 at the terminating end of guide rail 35, extending between the bifurcation portion of conveyor 23 in the flow path of product container 24. The adhesive surface of label 38 is positioned facing the approaching container 24 to assure abutting contacting interengagement of label 38 with the forward leading edge of flange 28 of product container 24. As product container 24 is advanced into contact with label 38, the label automatically adheres to the leading edge of flange 28. Once label 38 is affixed to the front edge of flange 28, label tamping arm assembly 32 is activated.

In this next step, as shown in FIGS. 3 and 5, tamping arm assembly 32 is activated, causing the central portion of label 38 to be forced into direct, wrap engagement with the top and bottom surfaces of flange 28 and securely affixed thereto. In addition, tamping arm assembly 32 also causes label 38 to be affixed to the front edge of upper portion 26 and lower portion 27 of product container 24. By employing label tamping arm assembly 32, the desired secure affixation of the central portion of label 38 directly to product container 24 in a tightly wrapped manner about flange 28 is realized and the conventional, prior art tenting of the label is eliminated.

In the preferred construction, label tamping arm assembly 32 comprises two actuator housings 42 and 43, each of which are mounted to support frame or plate 44, which is affixed to support table 22 of label applying apparatus 20. In addition, as best seen in FIG. 1, support frame 44 is adjustably movable relative to table 22 and conveyor 23 in order to assure the precisely desired positioning of actuator housings 42 and 43 relative to product container 24. In the preferred construction, a hand crank 45, as depicted in FIG. 1 is employed for controllably moving support frame 44 and actuator housings 42 and 43 into any desired position.

In the preferred construction, support frame 44 is vertically movable relative to table 22 and conveyor 23 in order to position actuator housings 42 and 43 in the requisite location for contacted interengagement with flange 28 of product container 24, regardless of the configuration of product container 24. In addition, it has been found that the secure mounting of actuator housings 42 and 43 to support frame 44 at a substantially 45 degree angular relationship is sufficient to enable label tamping arm assembly 32 to properly cooperate with any desired configuration of product container 24. However, if desired, alternate mounting configurations can be employed, such as securely affixing either or both actuator housings 42 and 43 to support frame 44 in a manner which enables arcuate pivoting movement of actuator housings 42 and 43 relative to support frame 44.

In the preferred embodiment, tamping arm assembly 32 comprises elongated shaft 46 which incorporates tamping head 40 mounted to its distal end, and elongated shaft 47 which incorporates tamping head 41 mounted to its distal end. As depicted, elongated shaft 46 is mounted in actuator housing 42, while elongated shaft 47 is mounted in actuator housing 43. In the preferred construction, elongated shaft 46 is cooperatively associated with actuator housing 42 for telescopic, axial movement relative to actuator housing 42 while shaft 47 is similarly constructed for axial, telescopic movement relative to actuator housing 43.

Typically, shaft 46 is retained within actuator housing 42, with tamping head 40 mounted to its distal end, spaced away from the flow path of product container 24. Similarly, shaft 47 is retained within actuator housing 43 with tamping head 41 mounted to its distal end, also spaced away from the flow path of container 24.

Once product container 24 advances along conveyor 23 and has label 38 affixed to the front edge of flange 28, label tamping arm assembly 32 is activated, causing elongated shafts 46 and 47 to be longitudinally extended outwardly from actuator housings 42 and 43. This longitudinal, axial movement causes tamping heads 40 and 41 to the brought into direct contact with label 38 along the top and bottom surfaces of flange 28. In this way, the central section of label 38 is securely wrapped and affixed directly to the top and bottom surfaces of flange 28. In addition, in the preferred construction, tamping heads 40 and 41 also cause label 38 to be brought into direct contact with the front end surfaces of upper portion 26 and lower portion 27 of product container 24, also securely affixing label 38 to those portions of container 24.

In order to assure that label 38 is securely affixed along its central area directly to container 24, wrapped neatly around flange 28 and the front end surfaces of upper portion 26 and lower portion 27, tamping heads 40 and 41 are constructed with a size and shape to effectuate the desired contacted, adhesive interengagement of label 38 with product container 24. By constructing tamping heads 40 and 41 in the precisely desired manner, with the surfaces thereof conforming to the construction of flange 28 and front ends of product container 24, any desired product container configuration is easily accommodated by label tamping arm assembly 32 to assure the secure affixation of label 38 to the product container in the desired manner.

In the preferred construction, the movement speed of shafts 46 and 47 as well as the stroke or travel length of shafts 46 in 47 out of and into housings 42 and 43 are controllably adjustable. In this way, any desired configuration of product container 24 is easily accommodated, assuring that label 38 is securely affixed and wrapped about flange 28 in the precisely desired manner. Furthermore, by adjusting these controllable functions of tamping arm assembly 32, continuous movement of product container 24 on conveyor 23 is assured and the movement and position of tamping heads 40 and 41 are controlled to prevent unwanted interference.

The final step in securely affixing label 38 to container 24 is the affixation of the remainder of label 38 to the top and bottom surfaces of container 24. In order to effectuate this final step, label securing brush assembly 33 is employed. As best seen in FIGS. 3 and 6, label securing brush assembly 33 preferably comprises and upper brush member 54 and a lower brush member 55.

In this preferred construction, upper brush member 54 is mounted in direct association with actuator housing 42, by employing bracket 56. Preferably, the position of brush 54 relative to actuator housing 42 is adjustable, in order to accommodate the wide variety of sizes and shapes that may be employed for product container 24. Typically, only vertical adjustment of upper brush member 54 is required, with the angular relationship being substantially identical for all containers 24. However, if desired, brush member 54 may be constructed to be arcuately pivotable relative to bracket 56 to position brush member 54 in any desired orientation.

Typically, upper brush member 54 may be positioned in any desired location along the length of conveyor 23. However, it has been found to be most desirable to position upper brush member 54 in close proximity to label tamping arm assembly 32, in order to securely affix label 38 to the top surface of product container 24 before the label contacts the top surface of container 24 due to the forces of gravity. By employing the present construction, secure adhesive attachment of label 38 to the top surface of container 24 is achieved without any wrinkling, bubbling, or unwanted folding of label 38.

In the preferred construction, lower brush member 55 is mounted to table 22 of label applying apparatus 20, positioned between the bifurcation portions of conveyor 23. In most instances, lower brush member 55 is merely fixedly mounted in the desired position, since substantially the same position can be used for securing label 38 to the bottom surface of any container 24. However, if desired, lower brush member 55 may be mounted to table 22 in a manner which allows brush member 55 to be adjustable in any desired direction or orientation.

Once product container 24 has been transferred through label securing brush assembly 33, the final, secure affixation of label 38 to container 24 is achieved. As is evident from the foregoing detailed discussion, the present invention assures that each and every label 38 is securely wrapped about forwardly protruding flange 38 of container 24 as well as the remainder of container 24, with all prior art problems totally eliminated.

In order to control the operation of label tamping arm assembly 33 and assure the secure, affixed, fully contacted engagement of label 38 with container 24 and its forwardly protruding flange 27, label applying apparatus 20 also incorporates a control system 60, depicted in FIG. 7. In the preferred embodiment, control system 60 comprises a sensor 61 which is cooperatively associated with conveyor 23 in order to monitor the movement of containers 24 on conveyor 23. Whenever sensor 61 determines the presence of a container 24, a signal is sent to timer 62.

In the preferred embodiment, sensor 61 comprises a photo sensor which is positioned in association with label dispensing head 31 in order to monitor the movement of containers 24 relative to label dispensing head 31. However, as is evident to one of ordinary skill in the art, any alternate sensor means can be employed and can be positioned in any desired alternate location, while still achieving substantially similar results.

Timer 61 is constructed to transmit an initiation signal to control means 63 after a predetermined interval of time has elapsed. In the preferred construction, timer 61 is adjustable to enable any desired time interval to be imparted thereto. In this way, activation of labels tamping arm assembly 32 is completely controllable and any container configuration is easily accommodated.

Once the preselected time interval has elapsed, timer 61 transmits an activation signal to control means 63. Once activated, control means 63 transmits a signal to label tamping arm assembly 32 causing label tamping arm assembly 32 to initiate its operation, bringing label tamping heads 40 and 41 into contact with label 38 and secure label 38 to flange 28 and container 24.

In the preferred construction, control means 63 incorporates adjustments for setting the movement speed and travel length of shafts 46 and 47 relative to actuator housings 42 and 43. In this way, container 24 may incorporate any configuration, while still enabling label tamping arm assembly 32 to contact container 24 in the precisely desired manner for attaining the secure, wrapped engagement of label 38 with flange 28 and the surfaces of container 24.

It will thus be seen that the objects set forth above, among those made apparent from the preceding description, are efficiently attained and, since certain changes may be made in carrying out the above process and in the constructions set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim is new and desire to seek your Letters Patent is:

1. Label applying apparatus for securely affixing a label to a container as the container advances on conveyor means with the label being affixed to the container in substantial, continuous, uninterrupted contacted interengagement therewith, said apparatus comprising a label tamping arm assembly comprising label smoothing/tamping means incorporating a leading surface constructed for simultaneously contacting at least two surfaces of said container for engaging a label and controllably moving the label into secure, contacted engagement with the surfaces of the container in secure, wrapped, contacting engagement therewith.

2. Label applying apparatus for securely affixing a label to a container having a forwardly protruding flange as the container advances on conveyor means, said apparatus comprising:

A. a label dispensing head constructed for retaining a plurality of labels and sequentially advancing at least one label into juxtaposed spaced relationship with a leading edge of the forwardly protruding flange of the container as the container is advanced by the conveyor means; and B. a label tamping arm assembly a. positioned forward of the leading edge of the forwardly protruding flange of the container in cooperating relationship with the label dispensing head, and b. comprising a pair of label smoothing/tamping means with each of said label smoothing/tamping means incorporating a leading surface constructed for engaging the label and simultaneously contacting at least two surfaces of said container, one of said surfaces being directly adjacent the leading edge of the forwardly protruding flange, controllably forcing the label into wrapped contacted interengagement with the forwardly protruding flange of the container in substantially continuous, uninterrupted, secure engagement therewith;

whereby label applying apparatus is achieved which securely wraps a label about the forwardly protruding flange of a container in continuous, contacted, uninterrupted, secure, interengagement with the flange of the container, avoiding any open zones or areas devoid of contact between the label and the container.

3. Label applying apparatus for securely affixing a label to a container having a forwardly protruding flange as the container advances on conveyor means, said apparatus comprising:

A. a label dispensing head constructed for retaining a plurality of labels and sequentially advancing at least one label into juxtaposed spaced relationship with the forwardly protruding flange of the container as the container; and B. a label tamping arm assembly positioned in cooperating relationship with the label dispensing head, and comprising label smoothing/tamping means constructed for engaging the label and controllably forcing the label into wrapped contacted interengagement with the flange of the container in substantially continuous, uninterrupted, secure engagement therewith; and C. a label smoothing brush assembly positioned in cooperating relationship with the label tamping arm assembly and constructed for affixing the terminating ends of a label to the top and bottom surfaces of the container, avoiding wrinkling, bubbling or folding of the label;

whereby label applying apparatus is achieved which securely wraps a label about the forwardly protruding flange of a container in continuous, contacted, uninterrupted, secure, interengagement with the flange of the container, avoiding any open zones or areas devoid of contact between the label and the container.

4. The label applying apparatus defined in claim 2, wherein each of said label smoothing tamping means is further defined as comprising:

a. at least one actuator housing positioned in cooperating relationship with the containers, b. an elongated shaft movably retained within the actuator housing and constructed for longitudinal, axial movement into and out of the housing, and c. said axially movable shaft comprising the label smoothing/tamping means mounted to the distal end thereof whereby axial movement of the shaft causes the leading edge of said label smoothing/tamping means to be brought into contacted engagement with the label and the two surfaces of the container simultaneously for controllably pushing the label into secure, affixed interengagement with the protruding flange of the container and the adjacent surface thereof.

5. The label applying apparatus defined in claim 4, wherein each of said label smoothing/tamping means is further defined as comprising a leading surface configuration conforming to the shape of the container and the forwardly protruding flange thereof in order to assure simultaneous contacted, nested engagement of the label smoothing/tamping means with the two surfaces of the container while having the label sandwiched therebetween, thereby providing smooth, continuous, contacted interengagement of the label with the flange and surfaces of the container.

6. The label applying apparatus defined in claim 4, wherein said actuator housing is further defined as being adjustably movable relative to the conveyor means in order to assure contacted interengagement with any container of any configuration.

7. The label applying apparatus defined in claim 6, wherein said actuator housing is further defined as being mounted relative to the container at an angle of about 45 degrees, in order to assure the desired contacted interengagement with the container and the protruding flange thereof.

8. The label applying apparatus defined in claim 4, wherein said label tamping arm assembly is further defined as comprising two separate and independent actuator housings, each incorporating an elongated shaft movably retained therein with separate and independent label smoothing/tamping means mounted at each distal end of each shaft, thereby providing two separate and independent label smoothing/tamping means contacting separate portions of the forwardly protruding flange of the container.

9. The label applying apparatus defined in claim 8, wherein each of said separate and independent actuator housings are mounted to a supporting frame member movably mounted relative to the conveyor means for assuring positioning of the actuator housings relative to the container in the precisely desired location regardless of the configuration of the container.

10. The label applying apparatus defined in claim 4, wherein the movement speed of the elongated shaft relative to the actuator housing is controllably alterable.

11. The label applying apparatus defined in claim 10, wherein the length of the shaft being axially displaced from the actuator housing is controllable, in order to assure precise contact of the label smoothing/tamping means with the container and forwardly protruding flange.

12. The label applying apparatus defined in claim 4, wherein said label tamping arm assembly further comprises d. control means for controlling the activation of the elongated shaft relative to the actuator housing, assuring precisely timed contacting interengagement of the label smoothing/tamping means with the container and its forwardly protruding flange.

13. The label applying apparatus defined in claim 3, wherein said label smoothing brush assembly is further defined as comprising two separate and independent brush members positioned for independently contacting and smoothing opposed terminating ends of each label directly onto the top surface of the container and the bottom surface of the container.

14. The label applying apparatus defined in claim 13, wherein the brush member constructed for smoothing the label onto the top surface of the container is further defined as being mounted in close proximity to the label tamping arm assembly in order to prevent contact of the label with the container due to gravitational forces.

* * * * *